United States Patent [19]

Babitzka et al.

[11] Patent Number: 4,984,744

[45] Date of Patent: Jan. 15, 1991

[54] ELECTROMAGNETICALLY ACTUATABLE VALVE

[75] Inventors: Rudolf Babitzka, Kirchberg-Neuhof; Ferdinand Reiter, Markgroeningen; Peter Romann, Stuttgart, all of Fed. Rep. of Germany

[73] Assignee: Robert Bosch GmbH, Stuttgart, Fed. Rep. of Germany

[21] Appl. No.: 424,644

[22] Filed: Oct. 20, 1989

[30] Foreign Application Priority Data

Dec. 24, 1988 [DE] Fed. Rep. of Germany ..... 3843862

[51] Int. Cl.[5] ..... B05B 1/30

[52] U.S. Cl. ..... 239/585; 251/129.19; 251/129.21

[58] Field of Search ..... 239/585; 251/129.19, 251/129.21

[56] References Cited

U.S. PATENT DOCUMENTS

| | | | |
|---|---|---|---|
| 2,698,159 | 12/1954 | Crum | 251/129.19 |
| 3,198,996 | 8/1965 | Vollprecht | 251/129.19 |
| 3,567,135 | 3/1971 | Gebert | 239/585 |
| 4,040,569 | 8/1977 | Knapp | 239/585 |
| 4,360,161 | 11/1982 | Claxton et al. | 239/585 |
| 4,483,485 | 11/1984 | Kamiya et al. | 239/585 |
| 4,759,331 | 7/1988 | Sausner | 251/129.19 |
| 4,784,322 | 11/1988 | Daly | 239/585 |

*Primary Examiner*—Andres Kashnikow
*Assistant Examiner*—Michael J. Forman
*Attorney, Agent, or Firm*—Edwin E. Greigg

[57] ABSTRACT

A connecting tube connected at one end to an armature of a fuel injection valve having a valve closing element secured to its other end. The connecting tube is easy to manufacture, it is simple to assemble, it has minimal weight and maximum strength. The connecting tube is resilient elastic and has openings along substantially its entire length and is easy to manufacture by rolling up a sheet-metal blank or by using a rigid spring element with spaced spring coils.

24 Claims, 3 Drawing Sheets

ELECTROMAGNETICALLY ACTUATABLE VALVE

BACKGROUND OF THE INVENTION

The invention is directed to improvements in electromagnetically actuatable valves. In an electromagnetically actuatable valve already proposed, although a connecting tube is provided between an armature and a ball serving as the valve closing element, the diameter of the connecting tube must be made with relative precision, so that the armature can be slipped over it and secured on it, and in the vicinity of the ball a plurality of flow openings radially penetrating the wall of the connecting tube are provided, though which the fuel flowing in from the armature to the interior can reach the valve seat. Additional work operations are necessary to make the flow openings. Because the relatively rigid connecting tube causes a hard impact of the valve closing member or armature on the valve seat or armature stop face, not only is there greater wear, but noise is also produced.

OBJECT AND SUMMARY OF THE INVENTION

The electromagnetically actuatable valve according to the invention has an advantage over the prior art that it can be manufactured at favorable cost; that a uniform hydraulic flow through it is assured; that the weight of the connecting element is quite low; and that its axial elasticity reduces wear, both in the region of the sealing seat and at the armature stop face on the face end. Additionally, because of damping, less noise is produced.

It is particularly advantageous to make the connecting element of sheet metal, for instance by rolling or bending rectangular sheet-metal blanks to produce the perforated connecting tube.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
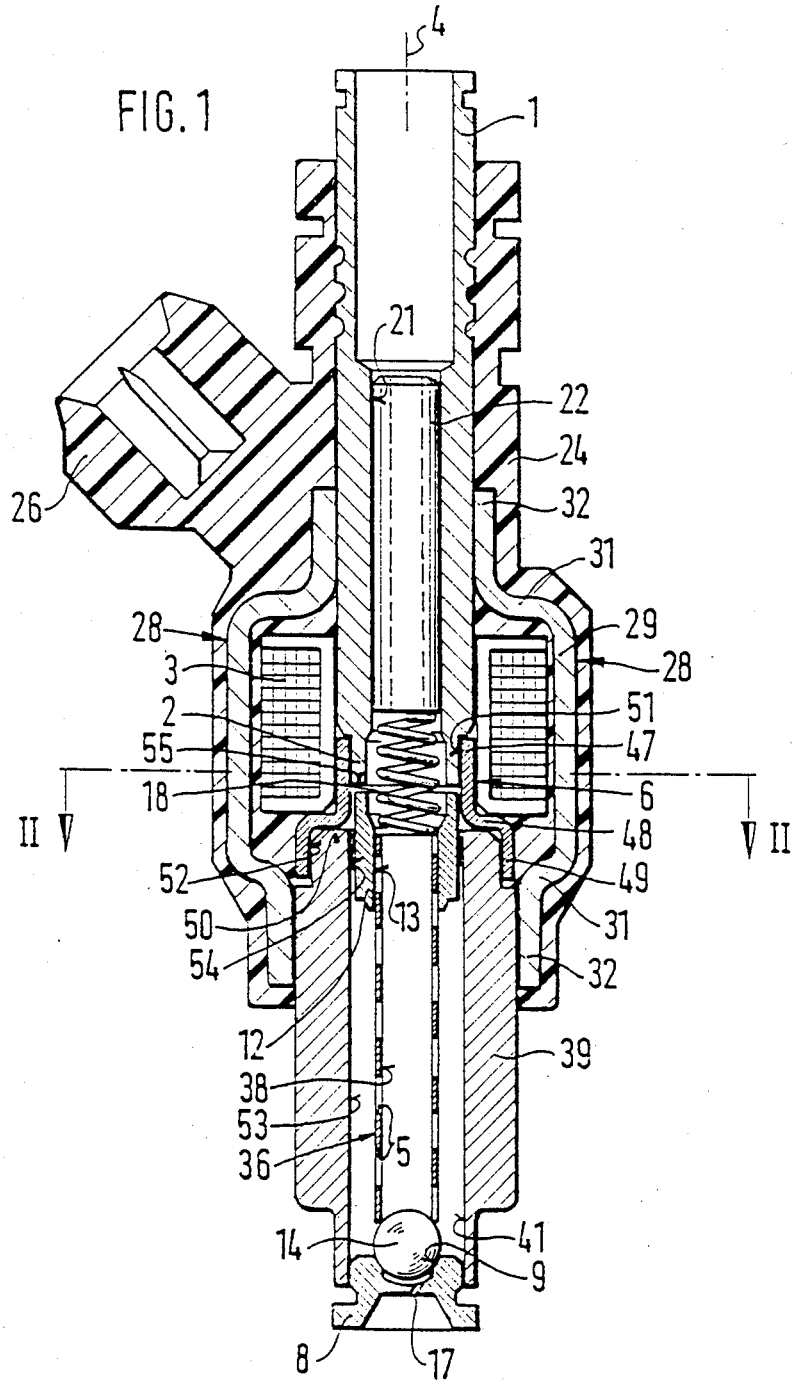
FIG. 1 shows a partial cross-sectional view of a valve embodied according to the invention.

The electromagnetically actuatable valve shown in a cross sectional view in FIG. 1, in the form of an injection valve for fuel as a component of a fuel injection system in a mixture-compressing internal combustion engine having externally supplied ignition, has a tubular metal connection neck 1 of ferromagnetic material, with a magnet coil 3 disposed on its circumference near the lower core end 2. The connection neck 1 thus serves as a core at the same time. An intermediate part 6 is joined tightly to the core end 2 of the connection neck concentrically with the longitudinal axis 4 of the valve, for instance by soldering or welding. The intermediate part 6 is made of deep-drawn nonmagnetic sheet metal, and has a first connecting segment 47 extending coaxially to the longitudinal valve axis 4 with which it completely surrounds and is tightly joined to the core end 2. A collar 48 extending radially outward from the first connecting segment 47 leads to a second connecting segment 49 of the intermediate part 6 that also extends coaxially to the longitudinal valve axis 4 and protrudes axially partway past a reduced diameter end of an outer connecting part 39 to which it is tightly joined, for instance by soldering or welding. The diameter of the second connecting segment 49 is thus larger in diameter than the diameter of the first connecting segment 47, so that in the assembled state, the tubular connecting part 39 rests with an end face 50 against the collar 48. To make as small an external size of the valve as possible, the first connecting segment 47 surrounds a retaining step 51 of the core end 2, which has a smaller diameter than the connection neck 1, and the second connecting segment 49 surrounds a retaining step 52 of the connecting part 39, this step likewise being embodied with a diameter smaller than the region adjoining it.

Remote from the end face 50, the outer connecting part 39, which is made of ferromagnetic material, has a retaining bore 41, into which a valve seat body 8 is tightly inserted, for instance by a screw connection or by welding or soldering. The retaining bore 41 merges with a transition bore 53, which in the vicinity of the end face 50 is adjoined by a slide bore portion 54, into which a cylindrical armature 12 protrudes and by which the armature 12 is guided. Thus, the retaining bore 41 and the slide bore portion 54 can both be made in the same chuck during manufacture, which makes it possible to produce bores that are very accurately aligned with one another. The armature 12 is guided neither by the intermediate part 6 nor by the transition bore 53 of the outer connecting tube 39. The axial length of the slide bore portion 54 is slight in proportion to the axial length of the armature 12, amounting to about 1/5 the length of the armature. A narrow, annular stop collar 55, the width of which is about 0.2 mm, is embodied on the core end 2 of the connection neck 1, oriented toward the armature 12.

Remote from the connection neck 1 and toward the core end 2 of the connection neck 1, the metal valve seat body 8 has a fixed valve seat 9. The succession of the connection neck 1, the intermediate part 6, the outer connecting part 39 and the valve seat body 8 is a rigid metal unit. One end of a thin-walled, round connecting tube, protruding into the transition bore 53 and serving as an inner connecting element 36, is inserted into and communicates with a securing bore 13 of the armature 12; communicating with the other end, oriented toward the valve seat 9, of the inner connecting element 36 is a valve closing element 14, which may for instance be in the form of a ball, a hemisphere, or of any other shape.

Remote from the valve closing element 14, a restoring spring 18 protrudes into the stepped securing opening 13 penetrating the armature 12 and on its other end rests for instance on an end face of the inner connecting tube 36. The other end of the restoring spring 18 protrudes into a flow bore 21 of the connection neck 1, where it rests on a tubular adjusting bushing 22 that for adjusting the spring tension is screwed or pushed into the flow bore 21. At least part of the connection neck 1 and the entire axial length of the magnet coil 3 are surrounded by a plastic sheath 24, which also surrounds at least a portion of the intermediate part 6 and outer connecting tube 39. The plastic sheath 24 may be made by compound filling or extrusion coating. An electrical connection plug 26, by way of which the electrical connection of the magnet coil 3 and hence its excitation are effected, is formed onto the plastic sheath 24 at the same time.

The magnet coil 3 is surrounded by at least one conducting element 28 made of ferromagnetic material that serves as a ferromagnetic element for guiding the magnetic field lines; in the axial direction, it extends over the entire length of the magnet coil 3, and at least partly surrounds the magnet coil 3 in the circumferential direction as well.

Figure 2:
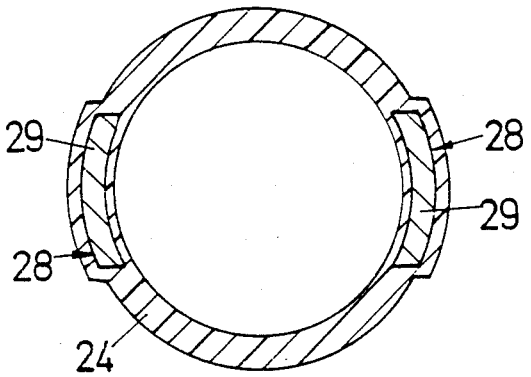
FIG. 2 is a partial section taken along the line II—II of FIG. 1.

The conducting element 28 is embodied in the form of bowed cylinder portion, with a convex midsection 29 adapted to the contour of the magnet coil that only partly surrounds the magnet coil 3 in the circumferential direction, and with radially inwardly extending end segments 31 that on each side, partly surround the connection neck 1 on the one side and the outer connecting part 39 on the other, and merges with a respective axially extending shell end 32. In FIGS. 1 and 2, a valve having two conducting elements 28 is shown.

Through bores 5 in the tube wall of the inner connecting tube 36 are provided, which connect the internal conduit 38 of the inner connecting tube 36 with the transition bore 53, so that the fuel flowing to the internal conduit 38 reaches this transition bore 53 and from there reaches the valve seat 9, dowstream of which in the valve seat body 8 at least one injection port 17 is provided, via which the fuel is injected into an intake tube (not shown) or cylinder of the engine.

In the exemplary embodiment of FIG. 1, two conducting elements 28 are provided, which may be oppositely disposed facing one another as shown in FIG. 2. To save space, it may be practical to have the electrical connection plug 26 extend in a plane that is rotated by 90° from that shown, or in other words for it to be perpendicular to a plane through the conducting elements 28.

Figure 3:
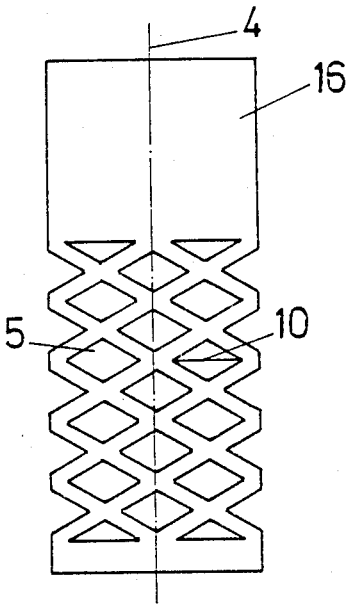
FIGS. 3 and 5 each show the jacket of a particular exemplary embodiment of the connecting tube, inserted in the armature as shown in FIGS. 4 and 6, respectively.
Figure 4:
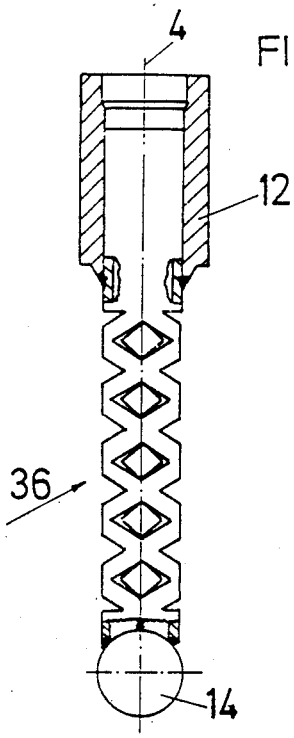

In FIG. 4, an exemplary embodiment of the inner connecting tube 36, already shown in FIG. 1, is shown with its armature 12 secured on one end and the valve closing element 14 joined to its other end. FIG. 3 is an enlarged view of the inner connecting tube 36. The inner connecting tube 36 and the armature 12 and valve closing element 14, respectively, are advantageously joined by welding or soldering. As can be seen in FIG. 3, diamond-shaped openings 5 are located in the jacket of the inner connecting tube 36; the longest axis of each opening is located in planes at right angles to the longitudinal valve axis 4. Similarly, the openings 5 could instead have an elliptical cross section. The upper region 16 of the jacket that is joined to the armature 12 has no openings. As FIG. 4 shows, in which the connecting tube 36 is seen in the installed state, the upper region 16 of the jacket protrudes only a short distance out of the armature 12, and the free portion between the armature 12 and the valve closing element 14 has a large number of openings 5, which are offset with respect to one another in successive planes. In other words, the fuel supplied to the inner connecting tube 36 can very quickly flow out of the internal conduit 38 through the many openings 5, into the transition bore 53 and thus reach the valve seat 9.

Figure 5:
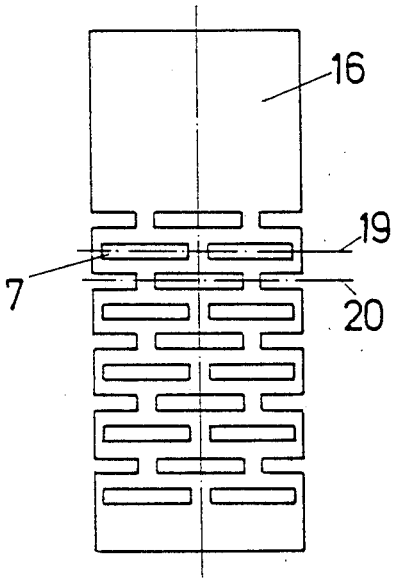
Figure 6:
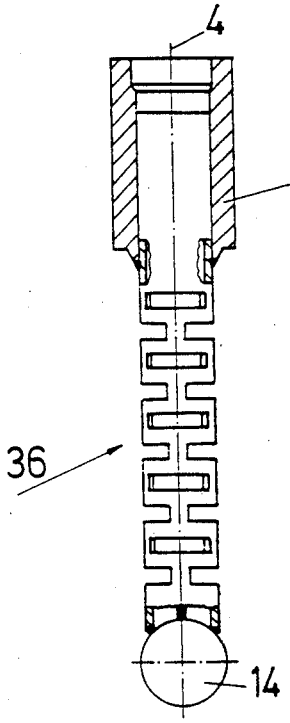

FIG. 6 illustrates a different embodiment for embodying the inner connecting tube, with FIG. 5 again showing an enlarged view of the inner connecting tube 36. Here, the openings 7 are in the form of rectangles, and they are offset from one another in adjacent planes 19, 20. It is advantageous for the thickness of the openings 7 and of the webs remaining between the various openings to have approximately the same dimensions, because by this means the area of the opening through which the medium flows is approximately equivalent to the unperforated surface area of the jacket. The openings 5 and 7 may have other suitable shapes than what is shown herein.

Because of the shape and arrangement of the openings 5 and 7, the inner connecting element 36 has a desirable elasticity, which in the manner described results in reduced wear and less noise. The inner connecting elements 36 ar advantageously made from sheet metal, for instance perforated rectangular sheet-metal blanks that are rolled or bent in such a way as to form round connecting tubes. The metal blanks may be bent such that the edges extending parallel to the longitudinal valve axis 4 are abutting, or such that they are spaced apart from one another, so that elasticity in the radial direction is also attained; this makes it possible to manufacture the securing opening 13 for the armature 12, the valve closing element 14 and the circumference of the inner connecting element 36 with greater tolerance.

The total cross section of all the openings 5 or 7 should be greater than the cross section of the inside diameter of the connecting tube 36, to enable an unimpeded flow of fuel out of the connecting element.

Figure 7:
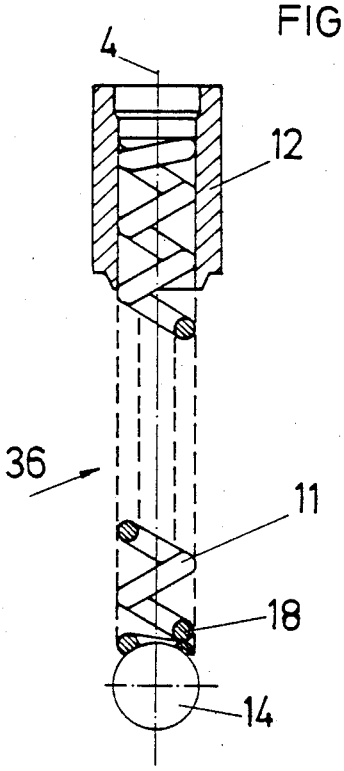
FIG. 7 shows a further embodiment of the invention illustrating a wire having a circular cross section.
Figure 7A:
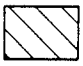
FIGS. 7*a*, 7*b*, and 7*c* illustrate a wire having a square cross section, a rectangular cross section, and an elliptical cross section, respectively.
Figure 7B:
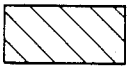
Figure 7C:
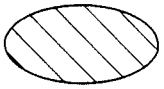

FIG. 7 shows completely different exemplary embodiment of the invention. Here, the inner connecting element 36 is embodied by a firm compression spring 11; on end of this compression spring 11 is surrounded by the armature 12 and secured there. The other end of the compression spring 11 is connected to the valve closing element 14. Because the compression spring 11 is relatively firm, a secure connection between the armature 12 and the valve closing element 14 is attained, yet an elasticity is available, so that wear is reduced both in the region of the sealing seat and on the armature stop face on the face end. The medium flowing through the spring 11 reaches the transition bore 53 and hence the valve seat 9 very quickly and uniformly. The cross section of the wire 18 comprising the compression spring 11 may be square, rectangular, circular or elliptical, as shown in FIGS. 7*a*, 7*b*, 7, and 7*c*, respectively. Especially when a circular wire is used as shown in FIG. 7, it is possible in the present case to use a compression spring available on the market, which makes for an extraordinarily favorable production cost for the connecting element.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An electromagnetically actuatable valve in a fuel injection valve for fuel injection systems in mixture-compressing internal combustion engines having externally supplied ignition, said fuel injection valve including a connection neck (1) that forms a fuel inlet, a core (2) formed on an inner end of said connection neck, said core is surrounded by a magnet coil (3), an armature (12) oriented axially toward one end of said core (2), an outer connecting part (39) connected at an upper end to said core (2), said outer connecting part including an inner bore (41), an outlet including a valve seat body (8) and a valve seat (9) secured to a lower end of said connecting part and a hollow inner connecting element coaxial with said outer connecting part (39) disposed concentrically to a longitudinal valve axis (4), said hollow inner connecting part firmly joined at one end to the armature and firmly joined at its other end to a valve closing element, and said hollow inner connecting element (11; 36) is formed of an axially resilient elastic material with at least one opening along its length, said fuel being communicated from said fuel inlet through said cores to an upstream end of said inner connecting element and through said at least one opening to said valve seat, said armature, inner connecting element and valve closing element being movable between positions permitting and preventing fuel flow through said outlet.

2. A valve as defined by claim 1, in which said inner connecting element (36) is embodied as a tube with a wall portion having rectangular openings (7).

3. A valve as defined by claim 2, in which said rectangular openings (7) are disposed in the wall in planes transverse to the longitudinal valve axis (4) and are offset axially in alternate planes from one another in a direction of the longitudinal valve axis (4).

4. A valve as defined by claim 3, in which a total of each cross section of each of the openings in the inner connecting element (11; 36) is equal to or greater than a cross section of the hollow connecting element (11; 36).

5. A valve as defined by claim 2, in which a total of each cross section of each of the openings in the inner connecting element (11; 36) is equal to or greater than a cross section of the hollow connecting element (11; 36).

6. A valve as defined by claim 1, in which said inner connecting element (36) is embodied as a tube with a wall portion having diamond-shaped openings (5).

7. A valve as defined by claim 6, in which a long axes (10) of each of the diamond-shaped openings (5) are located in planes transverse to the longitudinal valve axis (4).

8. A valve as defined by claim 7, in which a total of each cross section of each of the openings in the inner connecting element (11; 36) is equal to or greater than a cross section of the hollow connecting element (11; 36).

9. A valve as defined by claim 6, in which a total of each cross section of each of the openings in the inner connecting element (11; 36) is equal to or greater than a cross section of the hollow connecting element (11; 36).

10. A valve as defined by claim 1, in which said inner connecting element (36) has a segment (16) along a linear portion of its upper end which is free of any openings.

11. A valve as defined by claim 10, in which a total of each cross section of each of the openings in the inner connecting element (11; 36) is equal to or greater than a cross section of the hollow connecting element (11; 36).

12. A valve as defined by claim 1, in which said inner connecting element (36) is embodied as a compression spring (11) made of wire.

13. A valve as defined by claim 12, in which an upper end of the compression spring (11) is secured within an axial opening in said armature.

14. A valve as defined by claim 13, in which a cross section of the wire (18) of the compression spring (11) is square or rectangular.

15. A valve as defined by claim 14, in which a total of each cross section of each of the openings in the inner connecting element (11; 36) is equal to or greater than a cross section of the hollow connecting element (11; 36).

16. A valve as defined by claim 13, in which the cross section of the wire (18) of the compression spring (11) is circular or elliptical.

17. A valve as defined by claim 16, in which a total of each cross section of each of the openings in the inner connecting element (11; 36) is equal to or greater than a cross section of the hollow connecting element (11; 36).

18. A valve as defined by claim 13, in which a total of each cross section of each of the openings in the inner connecting element (11; 36) is equal to or greater than a cross section of the hollow connecting element (11; 36).

19. A valve as defined by claim 12, in which a cross section of the wire (18) of the compression spring (11) is square or rectangular.

20. A valve as defined by claim 19, in which a total of each cross section of each of the openings in the inner connecting element (11; 36) is equal to or greater than a cross section of the hollow connecting element (11; 36).

21. A valve as defined by claim 12, in which the cross section of the wire (18) of the compression spring (11) is circular or elliptical.

22. A valve as defined by claim 21, in which a total of each cross section of each of the openings in the inner connecting element (11; 36) is equal to or greater than a cross section of the hollow connecting element (11; 36).

23. A valve as defined by claim 12, in which a total of each cross section of each of the openings in the inner connecting element (11; 36) is equal to or greater than a cross section of the hollow connecting element (11; 36).

24. A valve as defined by claim 1, in which a total of each cross section of each of the openings in the inner connecting element (11; 36) is equal to or greater than a cross section of the hollow connecting element (11; 36).

* * * * *